United States Patent [19]

Aronstein

[11] Patent Number: 4,741,242

[45] Date of Patent: May 3, 1988

[54] AUTOMATIC INDICATING TUNING SYSTEM FOR VISUAL TUNING OF TIMPANI AND OTHER TUNABLE INSTRUMENTS

[75] Inventor: Jesse Aronstein, Poughkeepsie, N.Y.

[73] Assignee: Protune Corporation, Poughkeepsie, N.Y.

[21] Appl. No.: 927,177

[22] Filed: Oct. 29, 1986

[51] Int. Cl.[4] ..... G10G 7/02

[52] U.S. Cl. ..... 84/454; 84/DIG. 18

[58] Field of Search ..... 84/454, DIG. 18, 419

[56] References Cited

U.S. PATENT DOCUMENTS

| | | | |
|---|---|---|---|
| 4,023,462 | 5/1977 | Denov et al. | 84/454 |
| 4,457,203 | 7/1984 | Schoenberg et al. | 84/454 |
| 4,589,324 | 5/1986 | Aronstein | 84/454 |

*Primary Examiner*—Michael L. Gellner
*Assistant Examiner*—David M. Gray
*Attorney, Agent, or Firm*—Charles W. Helzer

[57] ABSTRACT

An automatically operated tuning indicating system for the preliminary tuning and for retuning during the performance of a set of timpani drums or other percussion-type instrument having a tunable resonating body cavity is provided. Automatic indication of tuning is achieved substantially in silence or at very low sound levels without requiring the production of an audible level of sound that could be readily detected by or distracting to persons in an orchestra other than the timpani player during the tuning and/or retuning. Tuning and/or retuning during a performance is under the visible control of the timpani player both as to which kettle drum of the timpani set or other musical instrument is being tuned and the extent of the tuning. The system is comprised by an automatic sound frequency signal analyzer for automatically comparing an electric input signal derived from the drum being struck to preset standards and for identifying and visually indicating on a dynamic display a particular note in the musical scale, or the closest note thereto whose frequency corresponds to the frequency of the input electric signal, and whether the note being played is sharp or flat and by how much. Respective sound signal sensors are provided for sensing the individual sound signals of each drum in the set being tuned and deriving a respective output electric signal for supply as the input signal to the automatic sound frequency signal analyzer. A wide band frequency responsive filter and amplifying circuit is connected between the outputs of all the sound signal sensors and the input to the automatic sound signal analyzer for facilitating picking up and displaying individual output signals from each drum being tuned in a simple, compact and easily manipulated tuning system that can be operated even during a performance for adjusting the pitch of any desired drum in the set without requiring the production of audible levels of sound to achieve the retuning.

21 Claims, 3 Drawing Sheets

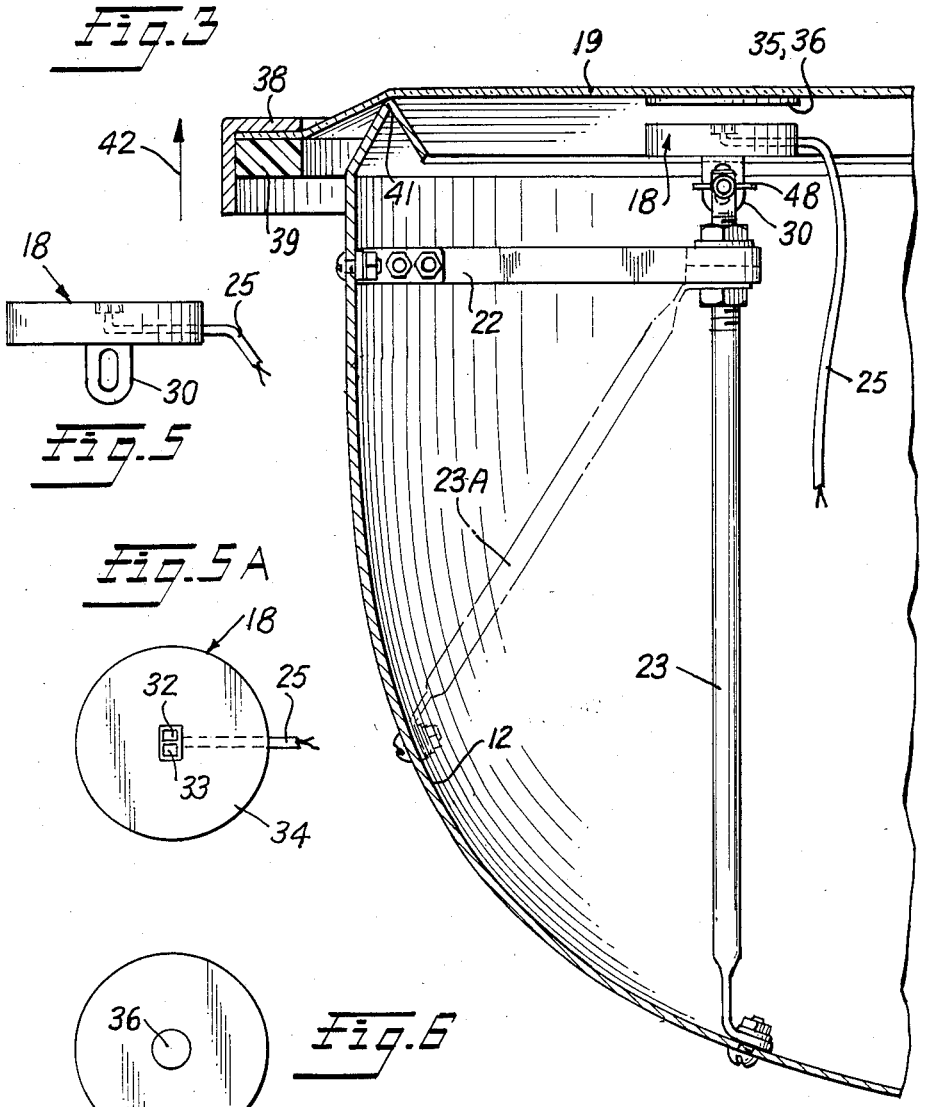
Fig. 3
19
35, 36
38
42
41
18
48
30
39
22
25
23A
23
12
18
25
30
Fig. 5
Fig. 5A
18
32
25
33
34
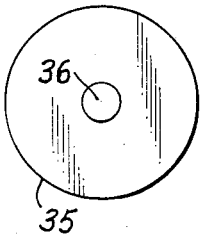
36
35
Fig. 6
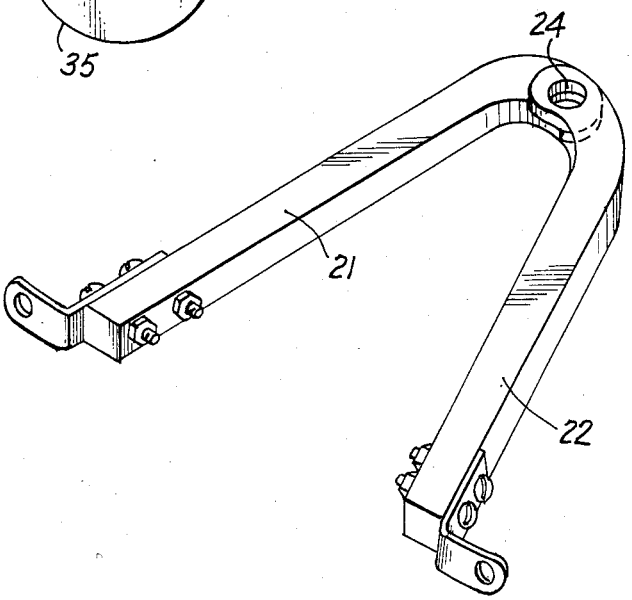
24
21
22
Fig. 4

Fig. 7
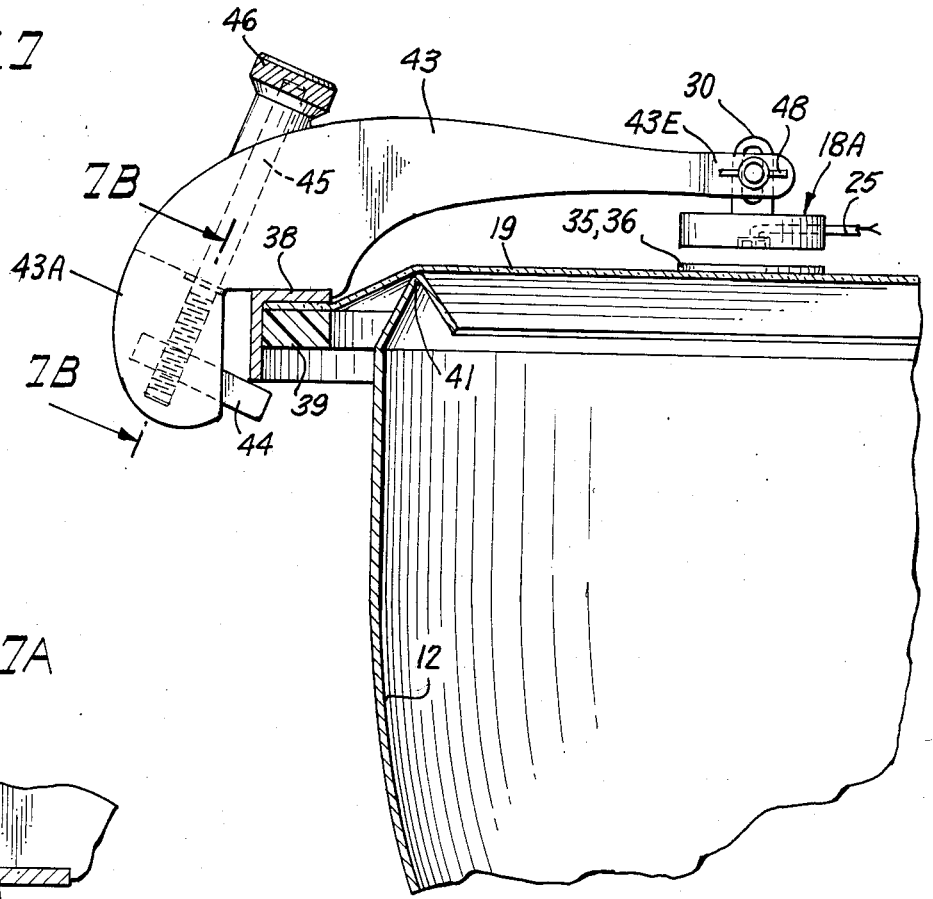
Fig. 7A
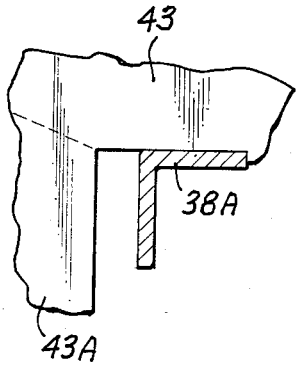
Fig. 7C
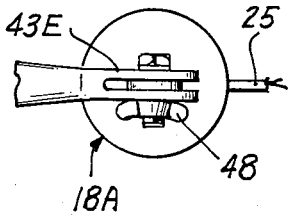
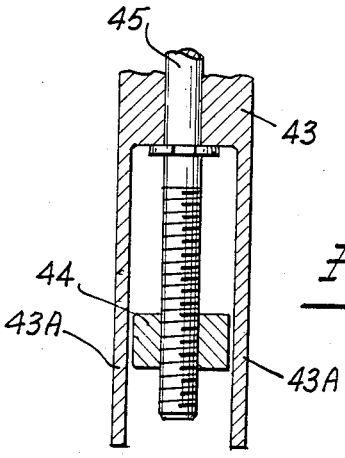
Fig. 7B

AUTOMATIC INDICATING TUNING SYSTEM FOR VISUAL TUNING OF TIMPANI AND OTHER TUNABLE INSTRUMENTS

TECHNICAL FIELD

This invention relates to a novel system for preliminary tuning and/or tuning during a performance of the frequency of operation of each one of a set of tunable musical instruments each of which operate over different preselected bands of frequencies within the sonic range.

More specifically, the invention relates to an automatically operated tuning system for preliminary tuning, as well as tuning during a performance, a set of kettle drums, referred to as timpani. Tuning can be visually achieved automatically substantially in silence or at very low sound levels without requiring the production of audible levels of sound or being readily detected by persons other than the player doing the tuning. Tuning is under the control of the player both as to which instrument is being tuned and the extent of tuning. The extent of tuning is immediate indicated to the player automatically by a display.

BACKGROUND PRIOR ART PROBLEM

Symphonic scores which employ a timpani set in many instances require that the timpanist change the tuning of certain of his drums at different points in the score in order to achieve a desired musical effect. To achieve this in the past timpanists have had to change the pitch of one or more of their drums during a performance on the basis of training and past experience relating to required tension settings for a given timpani in order to achieve a desired tonal effect. This is quite arduous, highly subject to error due to the fact that audible retuning has to be performed in a background setting of musical accompaniment by other members of the orchestra, and leaves much to be desired. To overcome this problem the present invention was devised.

SUMMARY OF INVENTION

It is therefore a primary object of the invention to provide an automatically operated tuning indication system for both the preliminary tuning and for retuning during the performance by a timpanist of any of a set of timpani drums. Tuning and/or returning can be achieved substantially in silence or at very low sound levels without requiring the production of audible levels of sound that could be readily detected by or distracting to other members of the orchestra.

Another object of the invention is to provide a novel automatic note and intonation indication system for a multiplicity of tunable musical instruments each of which is operable over a specific band of frequencies within the sonic range whereby each instrument may be separately tuned automatically in advance of or during a performance using a single sound signal analyzer having a visible display without requiring the production of audible sound levels to achieve the required tuning.

In practicing the invention a tuning system is provided for a multiplicity of tunable musical instruments wherein each instrument is operable over a specific band of frequencies within the sonic range. The tuning system includes an automatic sound frequency signal analyzer for receiving an electric input signal whose frequency characteristics correspond to the sound signal characteristics of the particular musical instruments being tuned and for automatically comparing the electric input signal to preset standards for identifying and visually indicating on a display a particular note in the musical scale or the closest note thereto whose frequency corresponds to the frequency of the input electric signal. The display also indicates whether the note being played is sharp or flat and by how much. Respective sound signal sensors are provided for sensing the individual sound signals of each musical instrument in the set of instruments being tuned and deriving a respective output electric signal for supply as an input signal to the automatic sound frequency signal analyzer. The system is completed by a wide-band frequency responsive filter and amplifying circuit responsive to the output electric signals from all of the sound signal sensors for all the musical instruments in the group being tuned.

Another feature of the invention is the provision of a tuning system specifically designed for use with a timpani set of kettle drums and other similar percussion-type tunable musical instruments, and wherein each sound signal sensor comprises an emitter/detector mounted in spaced relationship to the vibrating drum head of the timpani or other percussion-type instrument being tuned. A target member of extremely low mass such as paper or foil optionally is secured to and vibrates with the drum head in spaced-apart confronting relationship with the emitter/detector in a preferred embodiment of the invention whereby an electric signal whose frequency characteristics correspond to the sound signal characteristics of the percussion-type musical instrument being tuned, is derived without changing the acoustic properties of the percussion-type musical instrument. The percussion-type musical instrument preferably is one wherein the tension of the drum head or other vibrating element can be changed by a player even during a performance and the emitter/detector provides an output signal proportional to the gap distance between the spaced-apart end of the emitter/detector and the target member even though there may be a wide variation of such gap distance due to changing of the tension on the drum head or other vibrating element of the instrument as a result of retuning by the player during a performance.

A still further feature of the invention is the provision of an automatic tuning indicator for use in tuning systems such as those described above wherein the emitter/detector comprises an electrooptical infra red light emitter and juxtaposed infra red light detector pair mounted in spacedapart relationship with respect to the target member secured to and movable with the vibrating drum head or other vibrating element of the musical instrument being tuned. The target member has an infra red light reflecting surface directly opposite the infra red light emitter/detector and the gap defined between the spaced-apart elements forms an infra red light trap for ambient infra red light and keeps it from the target and the infra red light detector.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters, and wherein:

FIG. 3 is a partial sectional view taken through one of the timpani and shows the basic elements of the construction of an internally mounted sound signal frequency sensor constructed according to the invention for use with the timpani;

FIG. 4 is a perspective view of an adjustable internal bracket assembly for use in mounting the sound signal frequency sensor shown in FIG. 3;

FIG. 5 is a side elevational view of a sound signal frequency sensor assembly showing a preferred construction of the electro-optical infra red emitter/detector employed in practicing the invention;

FIG. 5A is a plan elevational view of the sensor shown in FIG. 5 as viewed from the bottom;

FIG. 6 is an elevational plan view of a thin, low mass target member of paper or foil which is secured on the vibrating drum head or other diaphragm or vibrating element of a musical instrument for optional use in conjunction with the electro-optical emitter/detector shown in FIG. 5 and FIG. 5A;

FIG. 7 is a partial sectional view of a timpani drum showing an externally mounted sound signal frequency sensor assembly for use universally on any timpani; and FIG. 7A through FIG. 7C show details of construction of parts of the externally mounted holder assembly for the electro-optical sensor shown in FIG. 7.

BEST MODE OF PRACTICING THE INVENTION

Figure 1:
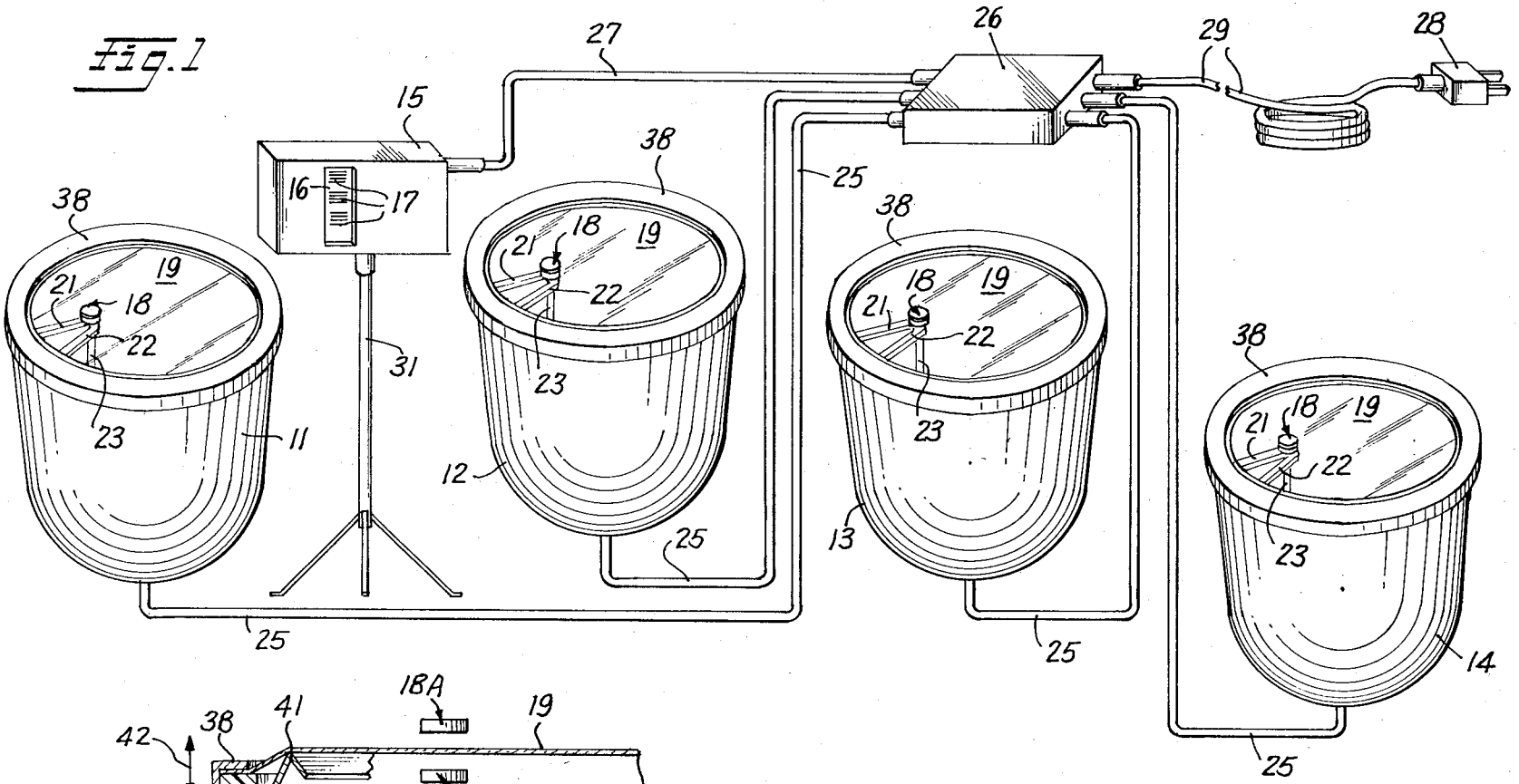
FIG. 1 is a schematic system diagram of a novel automatic tuning system according to the invention used in connection with a set of timpani comprised by four kettle drums.

FIG. 1 is an overall plan view of the invention showing a set of four kettle drums 11, 12, 13 and 14 which may be tuned to resonate at different frequencies within the sonic range. As discussed earlier, in many symphonic compositions it is necessary for the timpani player to change somewhat the tuning of one or more of the drums in the set in accordance with the score of the composition being played. To allow for this tuning, or retuning, during a performance, each of the kettle drums 11–14 is designed so that by appropriate manipulation of a system of mechanical linkages and a foot pedal, or some other similar mechanical arrangement, tensioning of the respective drum heads of the set can be adjusted so as to retune any particular one of the timpani over a range of about one octave. The manner in which this is achieved is well known and kettle drums for achieving such retuning during the performance of a composition have been available to orchestras for a number of years. The principal purpose of the present invention is to make available a novel automatic indicating tuning system whereby the timpani player can readily achieve such retuning visually during a performance (in addition to proper tuning in advance of a performance) in a substantially soundless manner, accurately and without fear of improper tuning due to background musical or noise sound levels under which such retuning has to be achieved. While only four timpani have been illustrated in the particular set being described, the invention can be applied to different numbers of drums and for that matter can readily be applied to other musical instruments wherein there is a vibrating element within an adjustable resonating cavity or sound box similar to that described above with relation to drums and other percussion-type musical instruments.

A principal element of the novel tuning system is an automatic sound frequency signal analyzer shown generally at 15 for receiving an electric input signal whose frequency characteristics correspond to the sound signal characteristics of any one of the four timpani 11-14 being played. The automatic sound signal analyzer 15 may comprise any known commercially available sound signal analyzer (commercially known as a tuner). Preferably, however, it is of the type manufactured and sold by Protune Corporation of Poughkeepsie, New York to whom this invention is assigned, and is described more fully in U.S. Pat. No. 4,457,203 issued July 3, 1984 for a "Sound Signal Automatic Detection and Display Method and System"—Schoenberg, et al.—inventors, the disclosure of which is hereby incorporated into the disclosure of this application in its entirety. It should be noted at this point, however, that while the Protune automatic sound signal analyzer preferably is used as the element 15 in practicing the present invention, the invention is not restricted to use only with the Protune analyzer, but can be made to work with any one of a number of automatic tuners now commercially available on the market.

For a more detailed description of the construction and operation of the automatic sound signal analyzer 15, reference is made to U.S. Pat. No. 4,457,203. However, for the purposes of this disclosure, the following brief description is believed adequate to provide an understanding of the analyzer and its manner of operation. The automatic tuner has a microphone or other sound transducer built into the analyzer that converts incoming sound waves into electric signals representative of the frequency of the sound signals being picked up. These electric signals are processed in a suitable processing circuit and supplied to a microcomputer. In the microcomputer the incoming sound frequency electric signal is compared to preset frequency standards for different musical notes established in a permanent memory within the microcomputer. The microcomputer is programmed to operate through comparison circuits so as to identify and indicate a particular note in the musical scale which is closest in frequency to the incoming sound signal frequency being analyzed and to display the closest note and indicate tuning accuracy on a liquid crystal display shown at 16 which comprises a part of the sound signal analyzer 15. For use in the present invention, the analyzer 15 has been provided with an additional input jack to allow for the application of sound frequency electric signals directly to the input of the analyzer.

Display 16 is described more fully in U.S. Pat. No. 4,589,324 issued May 20, 1986 for a "Dynamic Display for Automatic Sound Signal Analyzer"—Jesse Aronstein—inventor, the disclosure of which hereby is incorporated into the disclosure of this application in its entirety. Briefly, however, it should be noted that display 16 is a liquid crystal display which is capable of displaying a particular musical note such as a B or a C, etc., which is closest in frequency to the frequency of an incoming sound signal. The display also indicates whether the incoming sound signal is flat (♭) or sharp (♯) and by how much. For this purpose, display 16 includes suitably designed electrode patterns which are illuminated to display the above described information. The amount that an incoming sound signal is sharp or flat is depicted by a running pattern of bars similar to a stroboscope, as shown at 17, which move upwardly if the sound is sharp and move downwardly if the sound is flat, and the rate at which the bars move up or down is indicative of the extent that the sound being analyzed is either sharp or flat relative to the nearest musical note.

Referring again to FIG. 1, each of the timpani kettle drums 11–14 includes a respective sound signal frequency sensor such as that shown at 18 for timpani 12. The timpani such as those shown at 11–14 may have either transparent or translucent drum heads similar to that shown for the drum 12 and in which the sound signal sensor 18 is illustrated as being mounted within the drum body 12 on the underside of the surface of the transparent drum head 19. It is because of the transparent or translucent drum heads that the use of a target member 35, 36 shown in FIGS. 3 and 6 is required in order to block out ambient background light in the area where the drums are set up.

Figure 2:
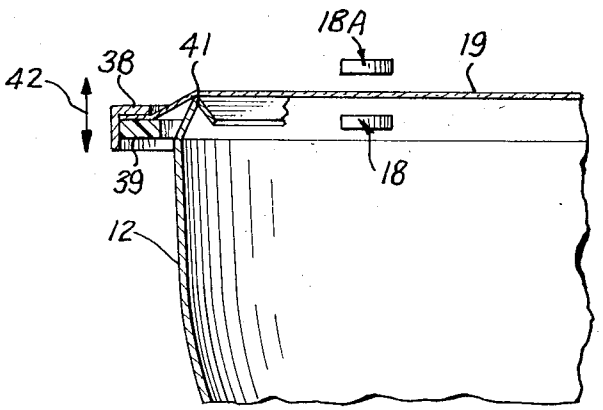
FIG. 2 is a partial sectional view taken through one of the timpani and illustrates the manner in which a sensor is mounted with respect to the drum head of the timpani for sensing the frequency of vibrations of the drum head even at sub-audible sound levels.

FIG. 2 is a partial, schematic, sectional view of the drum body of a timpani drum such as 12 showing the sound signal frequency sensor element 18 mounted below the drum head 19. In an alternative embodiment of the invention, the sound signal frequency sensor may be mounted in position above the drum head 19 as shown at 18A as will be described further hereinafter with relation to FIGS. 7 and 7A–7C of the drawings.

FIGS. 3 and 4 of the drawings illustrate how the sound signal frequency sensor 18 is permanently mounted within the drum body 12 by means of a set of adjustable bracket arms 21 and 22 and a vertical strut 23. The adjustable bracket arms 21 and 22 can be formed from identically constructed members which are swivelly connected together at their junction 24 and have the free ends thereof secured to the inside of the drum body walls 12 by through bolts and nuts (not numbered). The mounting bracket 21, 22, 22A and 23 is made adjustable so that the sound signal sensor can be mounted in existing holes in the kettle drum body without requiring the drilling of too many additional new holes.

The sound signal sensor 18 is supported in closely spaced, confronting relationship with the drum head 19 to provide about a ⅛th inch gap in the space between the end surface of the sound signal sensor 18 and the bottom surface of the drum head 19. As will be described hereafter with relation to FIG. 5, the sensor 18 preferably is an electro-optical, infra red light emitter/detector pair which derives an output electrical signal that can be supplied through an insulated conductor such as 25 secured to the vertical strut 23 and led out through the bottom portion of the kettle drum body 12 as depicted in FIG. 1.

As best shown in FIG. 1, the electric output signal conductors 25 from all of the sound signal sensors 18 in all of the kettle drums 11–14 are supplied to respective inputs of a wide band, frequency responsive filter and amplifying circuit 26. Filter amplifying circuit 26 is connected between the outputs of all of the sound signal sensors 18 for the respective timpani 11–14 and has a single output conductor 27 for supplying input electric signals to the electric signal input jack of the automatic sound signal analyzer 15. Wide band filter and amplifying circuit 26 is comprised by a plurality of narrow bandwidth frequency filter circuits with each narrow bandwidth frequency filter circuit being responsive to a particular narrow band of sound signal frequencies over which a respective one of the timpani 11–14 being tuned operates.

It should be noted at this point that while tuning initially, or while retuning, the timpani player will operate only one drum at a time, usually at a very low volume sound level (particularly during a performance). The sound signal frequency sensor associated with the particular timpani being operated will pick up the vibrations of the timpani drum head being struck and derives the desired output electric signal whose frequency characteristics correspond to the sound frequencies which will be emitted by the drum head at a particular drum head tension setting. This sound frequency electric signal will then be passed through the filter and amplifying circuit 26 to the electrical input jack of the automatic sound signal analyzer 15. As noted earlier, analyzer 15 is constructed and sold commercially both with a built-in microphone so that it can be operated directly with sound signals or, alternatively, it is provided with an electric signal input jack for electric signals such as those produced by the sensors 18 provided over the supply conductors 27 to analyzer 15.

It should be further noted that electric power supply indicated at 28 is applied through a power supply conductor 29 to the filter and amplifying circuit 26. Circuit 26 includes built-in circuitry for transmittting necessary electric power supply potential to the automatic sound signal analyzer 15. The power supply rectifier 28 is a standard, commercially available 115 volt - 60 cycle AC to DC converter for deriving required direct current electric potentials used to power the filter and amplifying circuit 26 and the automatic sound signal analyzer 15, as is well known in the industry. As shown in FIG. 1, the automatic sound signal analyzer with its built-in dynamic display 16 is separately mounted on a support stand 31 so it can be readily placed in a position that the timpani player can observe it while returning any one of the timpani drums 11–14 in the set. Alternatively, the analyzer can be mounted on a music stand by means of a clip provided for that purpose (not shown).

The sound signal sensor 18 may have many different forms; however, it is preferred that the sensor 18 comprise an electro-optical emitter 32 of infra-red (IR) light radiation and an IR detector 33. The emitter/detector pair 32, 33 is illustrated in FIG. 5 considered in conjunction with FIG. 5A, and the design is such as to minimize the effect of ambient background IR lighting. The use of an IR emitter/detector pair 32, 33 provides an output electric signal which is proportional to the distance between the emitter/detector and the drum head with or without a low mass, paper or foil target member, such as shown at 35, 36 in FIG. 6. The optionally used target member 35, 36 is secured by adhesive to the drum head 19 directly opposite, and spaced apart by a small gap distance of the order of one-eighth to one-quarter of an inch from the face of the IR emitter/detector pair 32, 33 shown in FIG. 5A. This provides an output electric signal proportional to the distance between the target member and the emitter/detector over a wide variation of gap distances between the emitter/detector pair and the target member. This is an important feature for ease of setup, and to allow for a range of gap spacings due to variation in tensioning of the drum head as will be described hereafter.

The IR emitter 32/detector 33 pair preferably comprises a known product on the market such as the Thompson Ramo Woolridge - TRW OPB #706B which is commercially available and has the IR emitter 32 and IR detector 33 pair centered within a single sensor body 18. As shown in FIGS. 5 and 5A, the sensor body 18 is large relative to the size of the active elements 32, 33 due to the fact that they are surrounded by a relatively large circular IR absorbing surface 34 that makes up the bulk of the face of the IR emitter/detector sensor body 18. Sensor body 18 is about one-half an inch thick and about one inch in diameter with the emitter/detector elements 32, 33 being encapsulated inside along with leads 25 and resistors, if needed. A suitable U-shaped mounting ear 30 is provided for mounting the sensor body.

The IR emitter/detector sensor 18 is positioned directly opposite from a thin stick-on foil or thin paper target member 35 of extremely low mass and which is composed primarily of infra red absorbing material but has a center section 36 of IR reflecting material. This IR reflecting center section 36 of the target is about the same size and area as the combined emitter/detector active elements 32 and 33 from which it is directly spaced apart. Thus, the geometry and design of the IR emitter/detector sensor head 18 is to provide a relatively small gap or spacing between the sensor head active elements 32 and 33 and the IR reflecting portion 36 of target member 35, and the relatively large surrounding areas of IR absorbing material 34, 35 on both sides of the gap between sensor 18 and target member 35 combine to form a trap for stray IR light coming from outside sources such as background electric lighting in the area where the orchestra is performing. The resulting structure provides a high signal to the noise ratio sensor system. Additional ambient light shielding can be achieved with optical filters in front of the sensing element.

It should be noted that the target member 35, 36 as a whole is made opaque to IR light and since most timpani heads are transparent or translucent, the opaque target member serves to block light from external sources of light that might otherwise be transmitted directly through the drum head to the IR emitter/detector active elements. It should be further noted that while an IR emitter/detector pair 32, 33 has been described as the preferred form of sensor, alternative sound frequency signal pick-ups can be used in its stead. For example, reflective light optical pick-ups in the visible band could be used, or magnetic or capacitance type pick-ups could be employed. For that matter, a mechanical contact, phonograph arm type of pick-up employing a linear differential transformer possibly could be used wherein the stylus rests lightly in a balanced manner on the target member. However, standard commercially available hardware for accomplishing this form of sound frequency sensing is so delicate that severe set-up and take-down precautions would have to be taken so that such technique would be impractical.

Because the sound signal frequency sensor 18 does not physically touch the drum head 19, it does not affect the acoustic properties of the drum. For most applications, the sensors are mounted inside the timpani where they are well protected, not in the way during set-up and takedown, and not visible to the audience. As mentioned earlier in the specification, the mounting brackets are designed to fit in existing bolt holes on most drum designs; however, for some drums new holes may have to be drilled to mount the internal support brackets for sensor 18.

In order to maximize the signal derived from the perceived "fundamental" note produced by the drum when struck, and to minimize the pick-up of overtones, the sound frequency sensor 18 preferably is positioned approximately one-half the distance into the center of the drum head opposite the area where the drum is struck by the player. This corresponds to one-quarter of the diameter of the drum head taken along a line which passes through the point on the drum where the player normally strikes the drum, but located on the opposite side of the center from such point. This relative positioning of the sensor 18 is illustrated in FIG. 2 of the drawings.

FIG. 2 also illustrates schematically the manner in which the tensioning of the drum head 19 can be changed even during a performance to thereby change the tuning or pitch of the sound produced by the drum. As shown in FIG. 2, the outer circumferential edge of the generally circular drum head 19 extends over and between an outer annular clamping ring 38 which has an L-shaped cross section and clamps the drum head 19 to a perimeter ring 39. The supports for the clamping ring and perimeter ring 39 have not been illustrated in order to simplify the illustration and not to unduly complicate the drawings. It is believed sufficient to point out that the clamping ring 38 and coacting perimeter ring 39 are physically positioned just below the upper annular lip or edge 41 of the drum body 12 so as to in effect draw the outer edges of the drum head 19 across the upper lip or edge 41. The supporting structural arrangement for the clamping ring 38 and coacting perimeter ring 39 includes mechanical linkages actuated by threaded rods and/or a foot pedal (not shown) for causing the rings 38 and 39 to be moved up or down as depicted by the dual-headed arrow 42 to thereby vary the tensioning of the drum head 19 and change its tuning or pitch over about one octave. The design is such that clamping ring 38 and perimeter ring 39 move over a vertical distance of about one-eighth of an inch to achieve such tuning.

The adjustable supporting mechanism for achieving the above briefly described tuning effect has long been available to the drum making industry and is well known in the art. During a performance, the timpanist operates a foot pedal or similar simple adjusting lever to cause the clamping ring 38 and perimeter ring 39 to be moved either up or down to thereby change the tension and tuning of the drum and this can be accomplished even during a performance. It should be noted, however, that such adjustment to achieve retuning of any one of the drums in the timpani set is done with respect to only one timpani at a time. While such tuning takes place, the player observes the visible note and either sharp or flat indicator as well as the moving pattern of strobe bars on the dynamic liquid crystal display 16 of analyzer 15 in order to precisely reset the tuning or pitch of a particular drum to a new desired value. This can be achieved with only minimal vibrations from the drum head by striking the drum head lightly. Thus, even though the player cannot hear the pitch or tone of the drum due to the ambient background sound level produced by the orchestra, by observing the visual patterns on dynamic display 16 the player can accurately retune any specific drum to a desired new pitch even during a performance.

FIG. 7 is a longitudinal sectional view taken through a timpani drum body 12 showing the manner in which the alternatively mounted sound signal sensor 18A can be supported exteriorly of the drum body and above the drum head 19. Sound signal sensor 18A is identical to that shown and described with relation to FIGS. 5 and 5A and is secured to the free end of a cantilever lever arm support 43. Cantilever support arm 43 has its fixed end clamped to the up and down movable drum head tensioning ring 38 by means of a clamping bar 44. Clamping bar 44 is threadably secured on the lower end of a pistol-like grip end 43A of support 43 by a threaded rod 45 whose upper end is secured to a knurled knob 46. As shown in FIG. 7 (and best seen in FIG. 7A), the under surface of the cantilever support arm 43 has a stepped portion which is designed to ride over and seat upon a leg portion 38A of the L-shaped drum head tensioning ring 38. This stepped portion is wider than the clamping ring top surface 38A to allow for variations in the size between timpani drums of different manufacturers. The cantilever support arm pistol-grip portion 43A is hollowed out at its lower end, as best seen in FIG. 7B, with the threaded adjusting rod 45 centrally disposed so that clamping bar 44 can be threaded into and retained between the two sides of the pistol-grip portion 43A lower end. The free end of the clamping bar 44 is designed to be pressed into engagement with the lower end of the drum head tension adjusting ring 38 as best seen in FIG. 7, and serves to clamp the adjusting arm in the position shown in FIG. 7 upon knurled knob 46 being turned in a direction to draw clamping bar 44 tightly up against the bottom edge of ring 38.

As best seen in FIG. 5 of the drawings, the sound sensor body member 18A has its mounting ear 30 extending upwardly but otherwise is constructed and operates identically to the IR emitter/detector 32, 33 shown and described with relation to FIG. 5 of the drawings. The mounting ear 30 is designed to slide between bifurcated lower ends 43E of the cantilever support arm 43 and is held in place at a desired height above the top surface of the drum head 19 by a wing nut 48, best seen in FIG. 7C of the drawings. The lower surface of the sensor element 18A is positioned immediately over a target member 35, 36 which is secured to the top surface of drum head 19 and is fabricated in the same manner as the target member 35, 36 shown and described with relation to FIG. 6. In this embodiment of the invention, the target member 35, 36 again is placed approximately one-quarter of the length of the diameter of the drum head 19 on the side of the center of the drum head away from the point where the player impacts the drum head.

From a consideration of FIG. 7 of the drawings, it will be appreciated why it is necessary that the sound frequency signal sensor 18 (18A) be designed to provide an output signal that is proportional to distance between the sensor and target member 35, 36 over a wide variation of gap distances. This characteristic feature is important for ease of set-up. It is also essential in order to allow the external mounting of cantilever support arm 43 to the drum head adjusting ring 38 in the manner shown. It is clear that when mounted in this manner, both the cantilever support arm 43, and the sensor head 18A move up and down as the player changes the tension of the drum head by vertically moving the tensioning ring 38 up or down as indicated by the arrow 42 shown in FIG. 2 of the drawings. Further, it is desirable to have the cantilever support arm 43 secured to the drum head tensioning adjustment ring 38 due to the fact that the drum head tensioning ring 38 is essentially the same construction for the various styles and brands of timpani drums. Hence, the cantilever support arm 43 assembly can be simply made to universally fit substantially all drums. It should be noted in this regard that the approximate 20 degree angle which the axis of threaded rod 45 makes relative to the vertical axis as shown in FIG. 7, accommodates unequal leg outer tensioning rings 38 over a ratio of about two to one.

Use of the IR-sensitive electro-optical pick-up allows only the vibrations of the drum head to be sensed so that the timpanist can tune a drum virtually silently even in high ambient background noise levels while other instruments in the orchestra are playing. This is achieved by sensing the drum head frequency of vibration through a spaced-apart gap between the sensor and the drum head so that the acoustic properties of the drum head are not affected by the presence of the sound signal sensor. The geometry of the IR emitter/detector is such as to maximize directly-reflected IR light signals from the emitter 32 back to the detector 33 and to block or trap light from outside light sources which otherwise might introduce a high level of background noise due to external light sources.

The use of an opaque target member 35, 36 (under conditions where its use is necessitated) further blocks outside light from striking the IR deflector, and serves to improve the signal to noise ratio. The target member with its large IR absorbing surface 35 in conjunction with the use of the IR light absorbing surface 34 surrounding the centrally positioned IR emitter/detector 32, 33 and IR light reflecting surface 36 centrally disposed on the target member 35, 36 creates a light trap that greatly minimizes any background noise pick-up due to external or background lighting sources.

Placement of the IR emitter/detector 32, 33 at a point approximately one-quarter of the distance of the diameter of the drum head i.e. one-half the way between the center of the drum head and the rim of the drum) on the side away from the area where the player contacts the drum head, results in maximizing the signal from the perceived "fundamental" note of the drum, and minimizes the pick-up of overtones.

The signals from the individual drum pick-up sensors are supplied to the electronic filter/amplifier unit 26 which serves to select a desired narrow range of frequencies being produced by the timpani drum being struck by the player. It should be noted that in practice, the timpanist tunes only one of the drums at a time so that all of the remaining drums are silent except for the one being struck. Thus, the player by striking only one of the drums in effect selects the particular narrow range of frequencies which is to be tuned or retuned. Hence, while the filter and amplifier unit 26 has a broad band input, at any given time, it is required to process only a selected narrow band range of frequencies from the selected timpani drum being struck, and provides an amplified output signal within the narrow band of frequencies to the automatic analyzer 15 for display on the dynamic liquid crystal display 16.

A single cord carrying both the signal to be displayed and power supply for operation of the analyzer 15 is connected between the filter and the amplifier circuit and the automatic analyzer so that it can be mounted on a separate stand as shown, or on a music stand. While a particular automatic sound signal analyzer unit 15 has been described, it is believed clear that the system can be made to work with many different types of automatic sound signal frequency analyzers available on the market. The system has been provided with an alternating current adapter type power supply so that it can be operated continuously during a performance and also with rechargeable batteries which are included in the filter/amplifier unit 26 to enable the novel tuning system to be used in locations where no suitable alternating current source is available. The design is such that the batteries will automatically be recharged via an alternating current rectifier build into plug 28 whenever it is plugged into an AC source.

INDUSTRIAL APPLICABILITY

From the foregoing description, it will be appreciated that the invention provides an automatically operated tuning indication system for the preliminary tuning, as well as tuning during a performance, of a set of timpani kettle drums. Tuning can be achieved visibly at very low sound levels without requiring the production of audible levels of sound that would be readily detected by persons other than the player doing the tuning. Tuning indication is automatic and under the control of the player both as to which instrument is being tuned and the extent of tuning.

Having described two embodiments of a novel automatically operated tuning system constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A tuner for percussion instruments such as drums having a vibrating membrane element comprising the drum head including in combination an automatic sound frequency signal analyzer for receiving an electric input signal whose frequency characteristics correspond to the sound signal characteristics of a particular drum being tuned and for automatically comparing the electric input signal to preset standards for identifying and visibly indicating on a display a particular note in the musical scale or the closest note thereto whose frequency corresponds to the frequency of the input electric signal and whether the note being played is sharp or flat and by how much; a sound signal frequency sensor for sensing vibrations of the vibrating membrane element of the drum being tuned and deriving an output electric signal for supplying as the input signal to the automatic sound frequency signal analyzer, the frequency of the electric signal corresponding to the frequency of vibration of the vibrating membrane element of the drum being tuned; and said sound signal frequency sensor comprising a non-contacting vibration sensor mounted in closely spaced-apart confronting relation to the vibrating membrane element of the drum for deriving the output electric signal whose frequency characteristics correspond to those of the drum being tuned without changing the acoustic properties of the drum vibrating membrane element, wherein the non-contacting vibration sensor comprises an electro-optical light emitter and juxtaposed light detector pair mounted in closely spaced-apart relationship with respect to the vibrating drum head of the drum being tuned, the vibrating drum head having secured thereto a target member having a light reflecting surface positioned thereon directly opposite the light emitter/detector pair; and means for blocking and trapping stray and ambient background light that might be transmitted through the drum head and preventing it from impinging on the light detector.

2. A tuner according to claim 1 wherein the drum being tuned is one wherein the tension of the vibrating membrane element such as the drum head of a kettle drum can be changed by a player of the instrument even during a performance and the non-contacting vibration sensor provides an output signal proportional to variations in the gap distance between the spaced-apart end of the emitter/detector and the target member light reflecting surface due to vibrations of the drum head even though there may be a wide variation of the starting gap distance due to changing of the tension in the drum head by the player during a performance.

3. A tuner according to claim 2 wherein the light reflecting target member surface is directly opposite the light emitter/detector pair; and wherein the means for blocking and trapping stray and ambient background light comprises the target member having a light absorbing surface surrounding the light reflecting surface and forming a light trap for preventing stray or ambient background light from striking the light detector and for maximizing the signal to noise ratio of the sensor output signal by reducing stray light reaching the light detector.

4. A tuner according to claim 3 wherein the emitter/detector is comprised by an electrically excited light emitter element mounted immediately adjacent a light detector element in the center of a large field of light absorbing surface material, and the target member is mounted on the drum head of the drum being tuned and comprises a center area of light reflecting material which is disposed immediately opposite the center mounted light emitter/detector and likewise is surrounded by a relatively larger area of light absorbing material whereby the gap between the emitter/detector and the target member forms a light trap except in the immediate center area of the target member where only the signal light emitted by the light emitter impinges and is reflected back to the light detector and the combined electro-optical emitter/detector and target member system functions as a light trap to block stray and ambient background light from outside sources and thereby reduce ambient background noise.

5. A tuner according to claim 1 wherein the emitter/detector is mounted on a kettle drum, a timpani, a tunable tom-tom or other similar drum and the emitter/detector and its coacting target member reflecting surface are mounted at a distance one quarter of the diameter of the drum head along a line on the opposite side of the center of the drum from the location where the player normally strikes the drum.

6. A tuner according to claim 4 wherein the electro-optical emitter/detector is mounted on a kettle drum, a timpani, a tunable tom-tom or other similar drum and the electro-optical emitter/detector and its coacting target member reflecting surface are mounted at a distance one quarter of the diameter of the drum head along a line on the opposite side of the center of the drum from the location where the player normally strikes the drum.

7. A tuner according to claim 1 wherein the emitter/detector is mounted on a kettle drum, timpani, tunable tom-tom or other similar drum inside the drum body with the emitter/detector closely spaced apart from the confronting the target member which is secured to the underside of the drum head and with the electro-optical emitter/detector being physically supported by a mounting bracket secured internally within the drum body in fixed spacial relationship with respect to the drum head and attached target member.

8. A tuner according to claim 4 wherein the electro-optical emitter/detector is mounted on a kettle drum, timpani, tunable tom-tom or other similar drum inside the drum body with the electro-optical emitter/detector being closely spaced apart from and confronting the target member which is secured to the underside of the drum head and with the electro-optical emitter/detector being physically supported by a mounting bracket secured internally to the drum head frame in fixed spacial relationship with respect to the drum head and attached target member.

9. A tuner according to claim 1 wherein the tunable musical instrument comprises a kettle drum, timpani, tunable tom-tom or other similar drum and the emitter/detector is mounted externally of the body of the drum by a cantilever support arm to which the emitter/detector is secured at one end for disposition in closely spaced-apart relationship to the vibrating head of the drum with the target member secured to the top surface of the drum with its reflecting surface in closely spaced-apart relationship to the end of the emitter/detector, and wherein the opposite end of the cantilever support arm is secured to a circumferentially surrounding outer ring which clamps the drum head to the top of the drum body and readily can be moved up or down by the player to adjust the tension of the drum head and therefore the tuning of the drum during a performance.

10. A tuner according to claim 4 wherein the drum comprises a kettle drum, timpani, tunable tom-tom or other similar drum and the electro-optical emitter/detector is mounted externally of the body of the drum by a cantilever support arm to which the electro-optical emitter/detector is secured at one end for disposition in closely spaced-apart relationship to the vibrating head of the drum with the target member secured to the top surface of the drum with its reflecting surface in closely spaced-apart relationship to the end of the electro-optical emitter/detector, and wherein the opposite end of the cantilever support arm is secured to a circumferentially surrounding outer ring which clamps the drum head to the top of the drum body and readily can be moved up or down by the player to adjust the tension of the drum head and therefore the tuning of the drum during a performance.

11. A tuning system for a multiplicity of tunable drums with each drum being operable over a specific bandwidth range of sound frequencies including in combination a single automatic sound frequency signal analyzer for receiving an electric input signal whose frequency characteristics correspond to the sound signal characteristics of a particular drum being struck and for automatically comparing the electric input signal to preset standards for identifying and visually indicating on a dynamic display a particular note in the musical scale or the closest note thereto whose frequency corresponds to the frequency of the input electric signal and whether the note being played is sharp or flat and by how much; respective sound signal frequency sensors for sensing the frequency of the individual sound signals of each drum being tuned and deriving a respective output electric signal for supplying as an input signal to the automatic sound frequency signal analyzer, the frequency of the electric signal corresponding to the frequency of sound of the respective drum being tuned; and wide band frequency responsive filter and amplifying circuit means responsive to the output electric signals from all of the sound signal frequency sensors for all of the drums in the group, said filter and amplifying circuit means being connected between the outputs of all of the sound signal sensors and the input to the automatic sound signal analyzer and comprising a plurality of narrow bandwidth frequency filter circuits with each narrow bandwidth frequency filter circuit being responsive to a particular narrow band of sound signal frequencies over which a respective one of the drums operates, said narrow bandwidth frequency filter circuits selectively and separately amplifying and supplying a respective input signal having a particular narrow range of sound frequency values to the input of the automatic sound signal analyzer for analysis and display while separately tuning each drum.

12. A tuning system according to claim 11 wherein the drums being tuned are kettle drums, timpani, tunable tom-tom and other similar drums; and wherein each sound signal frequency sensor comprises an emitter/detector mounted in spaced relationship to the vibrating drum head of each drum and having a target surface of low mass secured to and vibrating with the drum head in spaced-apart confronting relationship with the emitter/detector whereby an electric signal whose frequency characteristics correspond to the sound signal characteristics of the drum is derived without changing the acoustic properties of the drum.

13. A tuning system according to claim 12 wherein the drums being tuned are ones wherein the tension of the drum head or other vibrating element can be changed by a player of the drum even during a performance and the emitter/detector provides an output signal proportional to variations in distance between the spaced-apart end of the emitter/detector and the target member due to vibrations of the drum head even though there may be a wide variation of the starting gap distance between the emitter/detector and the target member due to changing of the tension in the drum head by the player during a performance.

14. A tuning system according to claim 13 wherein each emitter/detector comprises an electro-optical light emitter and juxtaposed light detector pair mounted in spaced-apart relationship with respect to the target surface secured to and movable with the vibrating drum head being tuned and wherein the target surface has a light reflecting surface directly opposite the light emitter and the gap defined between the spaced-apart emitter/detector and target member forms a light trap for preventing stray or ambient background light from striking the light detector and for maximizing directlyreflected light from the emitter to the reflective portion of the target surface and back to the light detector with maximum efficiency.

15. A tuning system according to claim 14 wherein the emitter/detector is comprised by an electrically excited electro-optical light emitter element mounted immediately adjacent a light detector element in the center of a large field of light absorbing surface material and the target surface comprises a lightweight target member mounted on the drum head and having a center area of light reflecting material which is disposed immediately opposite the center mounted light emitter/detector and likewise is surrounded by a relatively larger area of light absorbing material whereby the gap between the emitter/detector and the target member forms a light trap except in the immediate center area of the target member where only the signal light emitted by the light emitter impinges on the light reflecting center of the target member and is reflected back to the light detector and the combined electro-optical light emitter/detector and target member system functions as a light trap to block background ambient and stray light from outside sources from reaching the detector and thereby reduce ambient background noise.

16. A tuning system according to claim 12 wherein the emitter/detector is mounted on a kettle drum, a timpani, a tunable tom-tom or other similar drum and the emitter/detector and its coacting target surface are mounted at a distance one quarter of the diameter of the drum head along a line on the opposite side of the center of the drum from the location where the player normally strikes the drum.

17. A tuning system according to claim 15 wherein the electro-optical emitter/detector is mounted on a kettle drum, a timpani, a tunable tom-tom or other similar drum and the electro-optical light emitter/detector and its coacting target surface are mounted at a distance one quarter of the diameter of the drum head along a line on the opposite side of the center of the drum from the location where the player normally strikes the drum.

18. A tuning system according to claim 12 wherein the emitter/detector is mounted on a kettle drum, timpani, tunable tom-tom or other similar drum inside the drum body with the electro-optical emitter/detector closely spaced apart from and confronting a target member secured to the underside of the drum head and with the electrooptical emitter/detector being physically supported by a mounting bracket secured internally to the drum head frame in fixed spacial relationship with respect to the drum head and attached target member.

19. A tuning system according to claim 17 wherein the electro-optical emitter/detector is mounted on a kettle drum, timpani, tunable tom-tom or other similar drum inside the drum body with the electro-optical emitter/detector closely spaced apart from and confronting a target member secured to the underside of the drum head and with the electro-optical emitter/detector being physically supported by a mounting bracket secured internally to the drum head frame in fixed spacial relationship with respect to the drum head and attached target member.

20. A tuning system according to claim 12 wherein the percussion-type musical instrument comprises a kettle drum, timpani, tunable tom-tom or other similar drum and the emitter/detector is mounted externally of the body of the drum by a cantilever support arm to which the electro-optical emitter/detector is mounted at one end for disposition in closely spaced-apart relationship to the vibrating head of the drum with a target member secured to the top surface of the drum in closely spaced-apart relationship to the emitter/detector, and wherein the opposite end of the cantilever support arm is secured to a circumferentially surrounding outer ring which clamps the drum head to the top of the drum body and readily can be moved up or down by the player to adjust the tension of the drum head and therefore the tuning of the drum.

21. A tuning system according to claim 17 wherein the percussion-type musical instrument comprises a kettle drum, timpani, tunable tom-tom or other similar drum and the electro-optical emitter/detector is mounted externally of the body of the drum by a cantilever support arm to which the electro-optical emitter/detector is mounted at one end for disposition in closely spaced-apart relationship to the vibrating head of the drum with the target member secured to the top surface of the drum in closely spaced-apart relationship to the electro-optical emitter/detector, and wherein the opposite end of the cantilever support arm is secured to a circumferentially surrounding outer ring which clamps the drum head to the top of the drum body and readily can be moved up or down by the player to adjust the tension of the drum head and therefor the tuning of the drum.

* * * * *